US009129734B2

(12) United States Patent
Wei et al.

(10) Patent No.: US 9,129,734 B2
(45) Date of Patent: Sep. 8, 2015

(54) MAGNETIC MODULE AND BASE THEREOF

(75) Inventors: Po-Yu Wei, Taoyuan Hsien (TW); Ming-Cheng Lee, Taoyuan Hsien (TW); Yi-Lin Chen, Taoyuan Hsien (TW); Cheng-En Liao, Taoyuan Hsien (TW); Chia-Ming Liu, Taoyuan Hsien (TW); Chih-Ming Chen, Taoyuan Hsien (TW); Wei-Chin Chen, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 0 days.

(21) Appl. No.: 13/614,907

(22) Filed: Sep. 13, 2012

(65) Prior Publication Data

US 2013/0194061 A1 Aug. 1, 2013

(30) Foreign Application Priority Data

Feb. 1, 2012 (TW) ..... 101103210 A

(51) Int. Cl.
*H01F 27/29* (2006.01)
*H01F 27/30* (2006.01)
*H01F 17/04* (2006.01)

(52) U.S. Cl.
CPC ..... *H01F 17/043* (2013.01); *H01F 27/292* (2013.01)

(58) Field of Classification Search
CPC ... H01H 50/443; H01H 50/021; H01H 50/14; H01H 2050/446; H01H 50/04; H01H 11/06; H01H 2001/5888; H01H 27/29; H01H 27/266; H01F 27/29; H01F 2005/046; H01F 2007/062
USPC ..... 336/192, 196, 198, 199, 208, 212, 221, 336/223, 232
See application file for complete search history.

(56) References Cited

U.S. PATENT DOCUMENTS

| | | | | | |
|---|---|---|---|---|---|
| 3,110,874 | A | * | 11/1963 | Kane et al. | 336/210 |
| 3,727,157 | A | * | 4/1973 | Grunert et al. | 335/132 |
| 4,812,794 | A | * | 3/1989 | Asbell et al. | 335/151 |
| 4,975,666 | A | * | 12/1990 | Nobutoki | 335/78 |
| 5,153,550 | A | * | 10/1992 | Sugiura et al. | 336/192 |
| 6,262,651 | B1 | * | 7/2001 | Miyamoto et al. | 336/192 |
| 6,774,755 | B2 | * | 8/2004 | Nakata et al. | 336/83 |

(Continued)

FOREIGN PATENT DOCUMENTS

| | | |
|---|---|---|
| CN | 101834049 | 9/2010 |
| JP | H07245217 | 9/1995 |
| JP | H0945539 | 2/1997 |
| JP | H10303035 | 11/1998 |

(Continued)

*Primary Examiner* — Alexander Talpalatski
*Assistant Examiner* — Joselito Baisa
(74) *Attorney, Agent, or Firm* — Kirton McConkie; Evan R. Witt

(57) ABSTRACT

A magnetic module includes a magnetic element and a base. The magnetic element includes a conductive assembly and a magnetic core assembly. The conductive assembly includes a plurality of terminals. The magnetic core assembly is partially embedded within the conductive assembly. The base includes a base body and a plurality of conductive structures. The base body has a first surface, wherein the magnetic element is disposed on the first surface. The conductive structures are disposed on the base body and engaged with the plurality of terminals, so that the plurality of terminals are fixed by and electrically connected with the plurality of conductive structures, respectively.

7 Claims, 7 Drawing Sheets

(56) References Cited

U.S. PATENT DOCUMENTS

| | | | | |
|---|---|---|---|---|
| 7,116,204 | B2 * | 10/2006 | Fushimi | 336/208 |
| 7,259,650 | B2 * | 8/2007 | Sano | 336/212 |
| 7,443,277 | B2 * | 10/2008 | Yamaguchi | 336/208 |
| 7,460,002 | B2 * | 12/2008 | Estrov | 336/200 |
| 8,217,745 | B2 * | 7/2012 | Tien et al. | 336/83 |
| 8,766,756 | B2 * | 7/2014 | Hester et al. | 336/90 |

FOREIGN PATENT DOCUMENTS

| | | | |
|---|---|---|---|
| JP | H11297544 | | 10/1999 |
| JP | 2000077244 | | 3/2000 |
| JP | 2001155932 | | 6/2001 |
| JP | 2003318044 | A * | 11/2003 |
| JP | 2004342911 | | 12/2004 |
| TW | 350576 | | 1/1999 |

* cited by examiner

MAGNETIC MODULE AND BASE THEREOF

TECHNICAL FIELD

The present disclosure relates to a magnetic module, and more particularly to a magnetic module including a magnetic element and a base, in which the base having a plurality of conductive structures.

DESCRIPTION OF THE RELATED ART

Generally, an electrical appliance is equipped with several magnetic elements. The magnetic elements are for example transformers or inductors. Take an inductor as the magnetic element for example. FIG. 1A is a schematic exploded view illustrating a conventional inductor. FIG. 1B is a schematic assembled view illustrating the conventional inductor. As shown in FIG. 1A, the conventional inductor 1 includes a conductive assembly 11 and a magnetic core assembly 12. The conductive assembly 11 is produced by bending a metallic sheet (e.g. a copper sheet). Consequently, the conductive assembly 11 comprises a plurality of terminals 111 and a hollow portion 112. In addition, the terminals 111 are bent structures. A bottom surface 111*a* of the terminal 111 is connected with a circuit board (not shown) according to a surface mount technology (SMT). The magnetic core assembly 12 comprises two lateral posts 121 and a middle post 122. The middle post 122 is penetrated through the hollow portion 112 of the conductive assembly 11. The two lateral posts 121 of the magnetic core assembly 12 are located on opposite sides of the magnetic core assembly 12. After the conductive assembly 11 is sandwiched between the magnetic core assembly 12, the inductor 1 is assembled (see FIG. 1B). Then, the inductor 1 may be electrically connected with the circuit board through the terminals 111.

From the above discussions, the conventional inductor 1 is a combination of the conductive assembly 11 and the magnetic core assembly 12. In a case that the inductor 1 is applied to an electronic device requiring larger voltage, the conductive assembly 11 should be produced by a wider conductive sheet. After the conductive assembly 11 and the magnetic core assembly 12 are combined as the inductor 1, it is difficult to fix the conductive assembly 11 on the circuit board. In addition, the conductive assembly 11 is possibly aslant, and thus a short-circuited problem may occur at the region between the conductive assembly 11 and the magnetic core assembly 12. Under this circumstance, the performance of the inductor 1 is deteriorated. Moreover, the bottom surfaces 111*a* of the terminals 111 of the conventional inductor 1 are attached on the circuit board according to the surface mount technology (SMT) by a placement machine. During the circuit board and the inductor 1 are transferred through a reflow furnace, the high temperature may deform the terminals 111 of the inductor 1. Due to the deformation of the terminals 111, the poor contact between the inductor 1 and the circuit board may impair the performance of the inductor. In addition, since the bottom surfaces 111*a* of the terminals 111 have reduced evenness, the inductor 1 fails to lie flat on the circuit board.

Therefore, there is a need of providing a magnetic module and a base thereof in order to obviate the above drawbacks.

BRIEF SUMMARY

The present disclosure provides a magnetic module and a base thereof to minimize the possibility of causing deformation during the magnetic module is transferred through the reflow furnace in order to increase the evenness of the terminals and enhance the performance of the magnetic module.

In accordance with an aspect of the present disclosure, there is provided a base for holding a magnetic element. The magnetic element includes a conductive assembly and a magnetic core assembly. The conductive assembly has a plurality of terminals. The base includes a base body and a plurality of conductive structures. The base body has a first surface. The magnetic element is disposed on the first surface. The conductive structures are disposed on the base body and engaged with the plurality of terminals, so that the plurality of terminals are fixed by and electrically connected with the plurality of conductive structures, respectively.

In accordance with another aspect of the present disclosure, there is provided a magnetic module. The magnetic module includes a magnetic element and a base. The magnetic element includes a conductive assembly and a magnetic core assembly. The conductive assembly includes a plurality of terminals. The magnetic core assembly is partially embedded within the conductive assembly. The base includes a base body and a plurality of conductive structures. The base body has a first surface, wherein the magnetic element is disposed on the first surface. The conductive structures are disposed on the base body and engaged with the plurality of terminals, so that the plurality of terminals are fixed by and electrically connected with the plurality of conductive structures, respectively.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
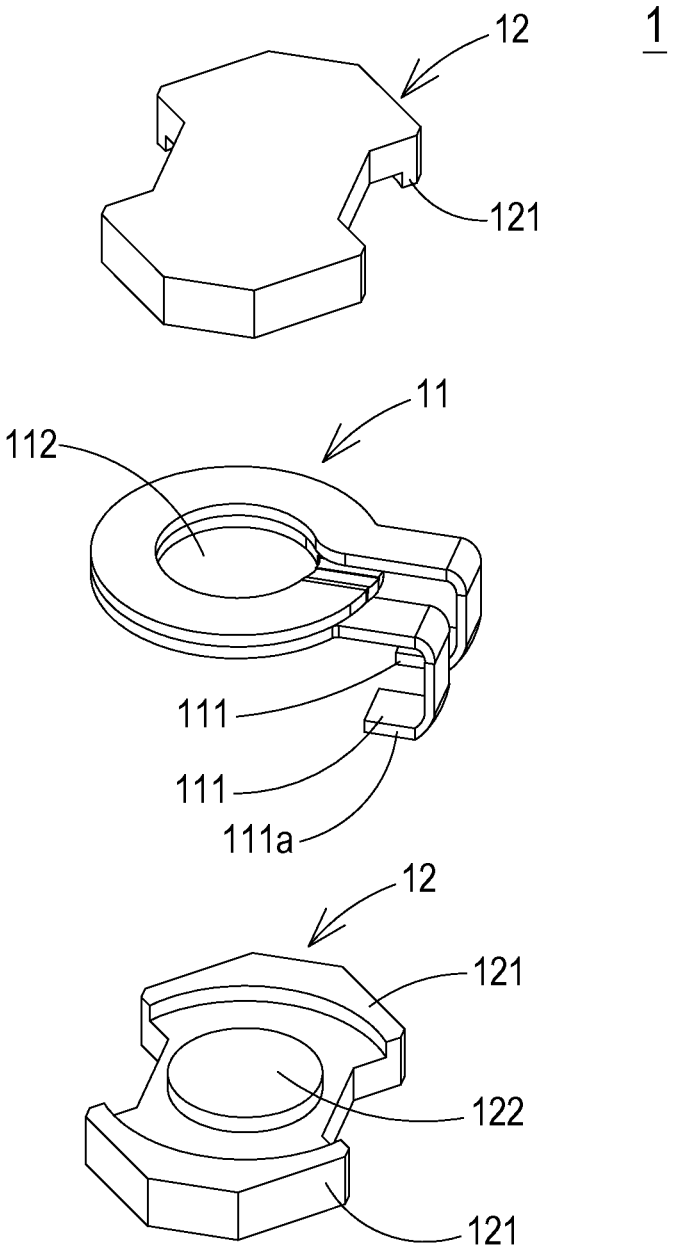
FIG. 1A (PRIOR ART)
FIG. 1A is a schematic exploded view illustrating a conventional inductor.
Figure 1B:
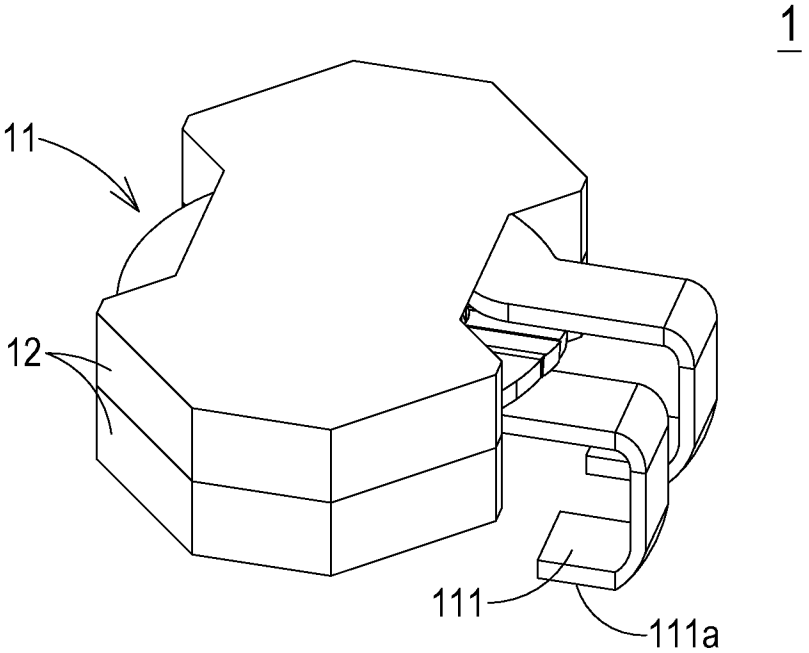
FIG. 1B (PRIOR ART)
FIG. 1B is a schematic assembled view illustrating the conventional inductor.
Figure 2:
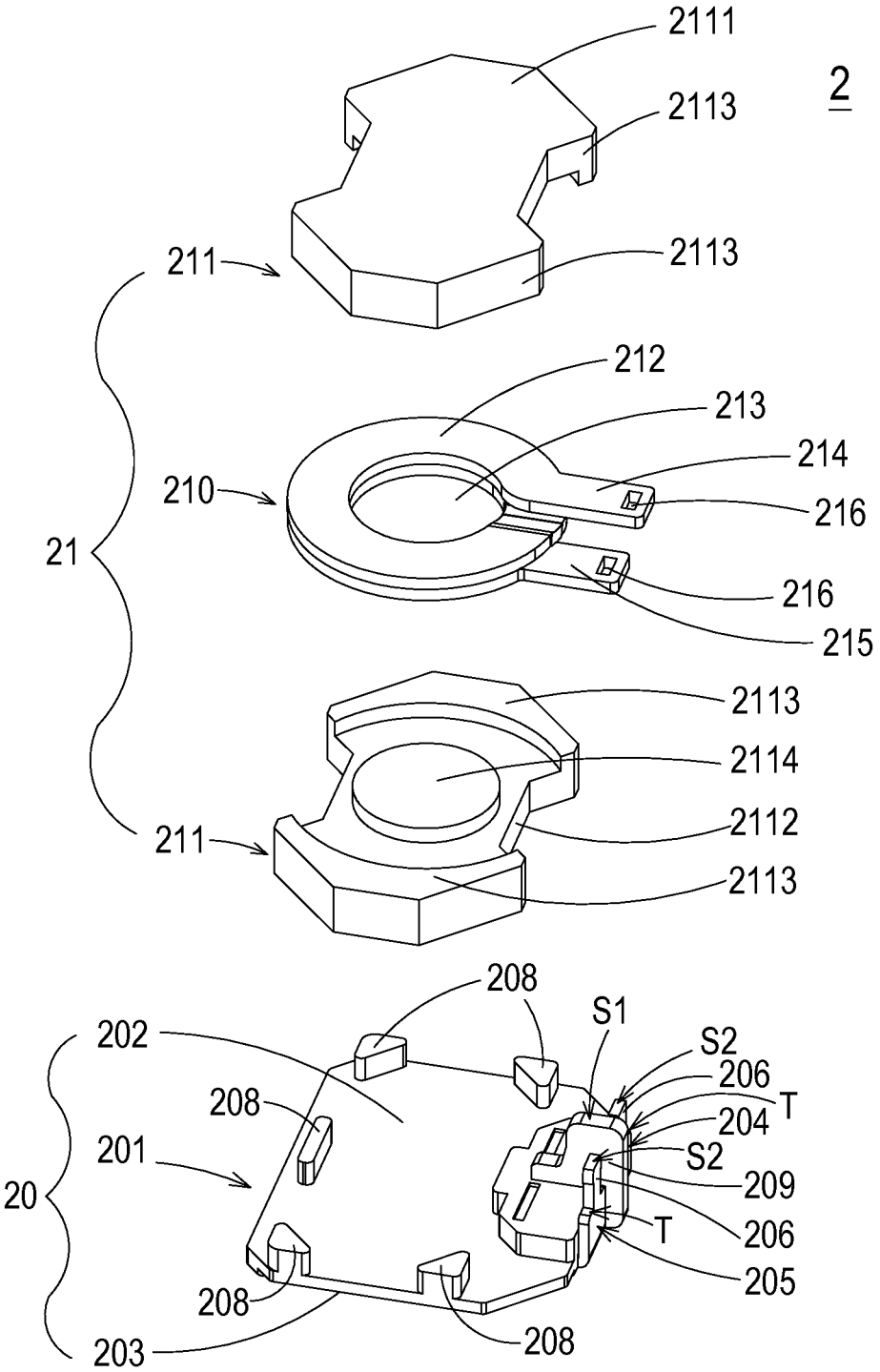
FIG. 2 is a schematic exploded view illustrating a magnetic module according to a first embodiment of the present disclosure.

FIG. 2 is a schematic exploded view illustrating a magnetic module according to a first embodiment of the present disclosure. As shown in FIG. 2, the magnetic module 2 is a surface mount device (SMD). The magnetic module 2 comprises a base 20 and a magnetic element 21. An example of the magnetic element 21 includes but is not limited to an inductor. In this embodiment, the magnetic element 21 is an inductor, which is just for example and not to limit the disclosure. The inductor 21 comprises a conductive assembly 210 and a magnetic core assembly 211. The conductive assembly 210 is produced by bending a metallic sheet (e.g. a copper sheet). Consequently, the conductive assembly 210 comprises a main body 212 and a plurality of terminals (e.g. a first terminal 214 and a second terminal 215). The main body 212 has a hollow portion 213. Each of the first terminal 214 and the second terminal 215 has a fixing part 216. In this embodiment, the fixing part 216 is a rectangular slot. The magnetic core assembly 211 comprises a first magnetic core part 2111 and a second magnetic core part 2112. Each of the first magnetic core part 2111 and the second magnetic core part 2112 has two lateral posts 2113 and a middle post 2114. The middle post 2114 of the first magnetic core part 2111 and the middle post 2114 of the second magnetic core part 2112 are both embedded into the hollow portion 213 of the conductive assembly 210. In addition, the lateral posts 2113 of the first magnetic core part 2111 are aligned with respective lateral posts 2113 of the second magnetic core part 2112. Consequently, after the conductive assembly 210 is sandwiched between the first magnetic core part 2111 and the second magnetic core part 2112, the inductor 21 is assembled. In this embodiment, the first magnetic core part 2111 and the second magnetic core part 2112 are collectively formed as an EE-type magnetic core assembly. According to practical requirements, the shape of the magnetic core assembly 211 may be varied.

Figure 3:
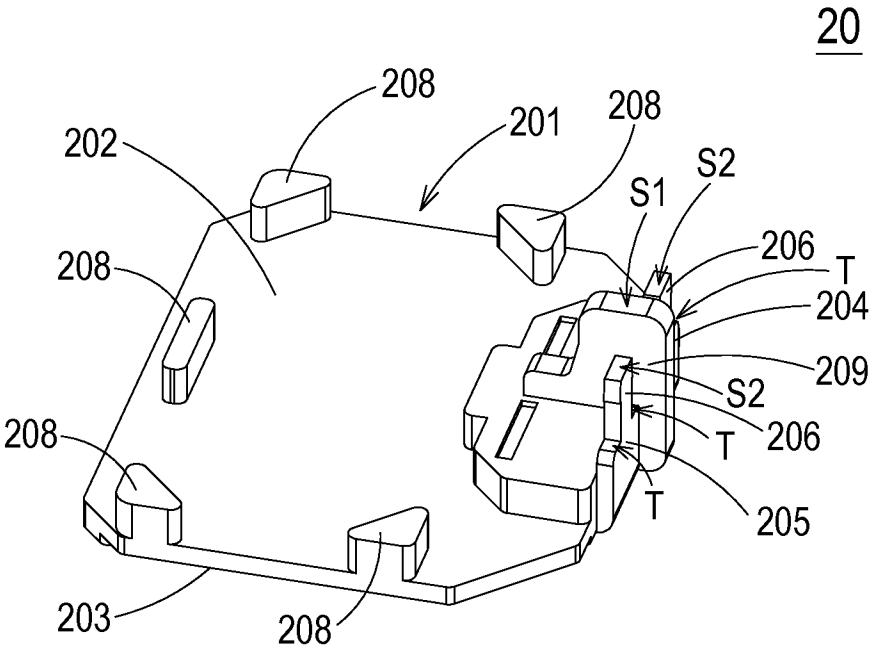
FIG. 3 is a schematic perspective view illustrating the base used in the magnetic module of FIG. 2.

FIG. 3 is a schematic perspective view illustrating the base used in the magnetic module of FIG. 2. Please refer to FIGS. 2 and 3. The base 20 is made of an insulating material. The base 20 is also a surface mount device (SMD). The base 20 is used for holding the inductor 21. In this embodiment, the base 20 comprises a base body 201 and a plurality of conductive structures (e.g. a first conductive structure 204 and a second conductive structure 205). The base body 201 has a first surface 202 and a second surface 203. The first surface 202 and the second surface 203 are opposed to each other. Moreover, a plurality of position-limiting structures 208 and a partition plate 209 are formed on the first surface 202 of the base body 201. The position-limiting structures 208 have a profile matching the shape of the magnetic core assembly 211, so that the magnetic core assembly 211 is positioned and surrounded by the position-limiting structures 208. The partition plate 209 has a top surface S1, and the plurality of conductive structures have top surfaces S2. The top surface S1 of the partition plate 209 is at a horizontal level higher than the top surfaces S2 of the plurality of conductive structures. In this embodiment, the profiles of the position-limiting structures 208 match the shape of the EE-type magnetic core assembly, so that the magnetic core assembly 211 is positioned by the position-limiting structures 208. The partition plate 209 is also formed on the first surface 202 of the base body 201, and arranged between the first conductive structure 204 and the second conductive structure 205. During the process of soldering the magnetic module 2 on the circuit board, the first conductive structure 204 and the second conductive structure 205 should be coated with solder paste (not shown). Since the solder paste on the first conductive structure 204 and solder paste on the second conductive structure 205 are isolated by the partition plate 209, the possibility of causing a short-circuited problem during the process of soldering the magnetic module 2 on the circuit board will be minimized.

Please refer to FIGS. 2 and 3 again. The first conductive structure 204 and the second conductive structure 205 are vertically disposed on the first surface 202 of the base body 201 of the base 20. In addition, the first conductive structure 204 and the second conductive structure 205 are aligned with the first terminal 214 and the second terminal 215 of the conductive assembly 210, respectively. After the inductor 21 is disposed on the base 20, the first conductive structure 204 and the second conductive structure 205 are connected with the first terminal 214 and the second terminal 215 of the conductive assembly 210, respectively. Moreover, each of the first conductive structure 204 and the second conductive structure 205 has a protrusion part 206 and, a bottom part 207 (see FIG. 4B) and a stepped part T. Each protrusion part 206 of the first conductive structure 204 and the second conductive structure 205 is extended from corresponding stepped part T. The bottom part 207 is attached on the second surface 203 of the base 20 so that the first conductive structure 204 and the second conductive structure 205 are fixed on the base body 201. After the magnetic module 2 is fabricated, the bottom part 207 may be connected with the circuit board according to a surface mount technology (SMT), so that the magnetic module 2 is electrically connected with the circuit board. The protrusion parts 206 of the first conductive structure 204 and the second conductive structure 205 are aligned with the fixing parts 216 of the first terminal 214 and the second terminal 215, respectively. The profile of the protrusion part 206 matches the shape of the corresponding fixing part 216. When the inductor 21 is disposed on the base 20, the protrusion parts 206 are engaged with corresponding fixing parts 216. Consequently, the conductive assembly 210 is fixed on the base 20 without being shifted.

In some embodiments, a plurality of concave structures 2031 (see FIG. 4B) are formed in the second surface 203 of the base body 201 of the base 20. The concave structures 2031 are aligned with the first conductive structure 204 and the second conductive structure 205. Consequently, the bottom parts 207 are partially accommodated within and fixing within the concave structures 2031. In such way, the evenness of the magnetic module 2 will be largely enhanced. In this embodiment, the base 20 has two concave structures 2031. The number of the concave structures 2031 is equal to the number of the conductive structures.

Figure 4A:
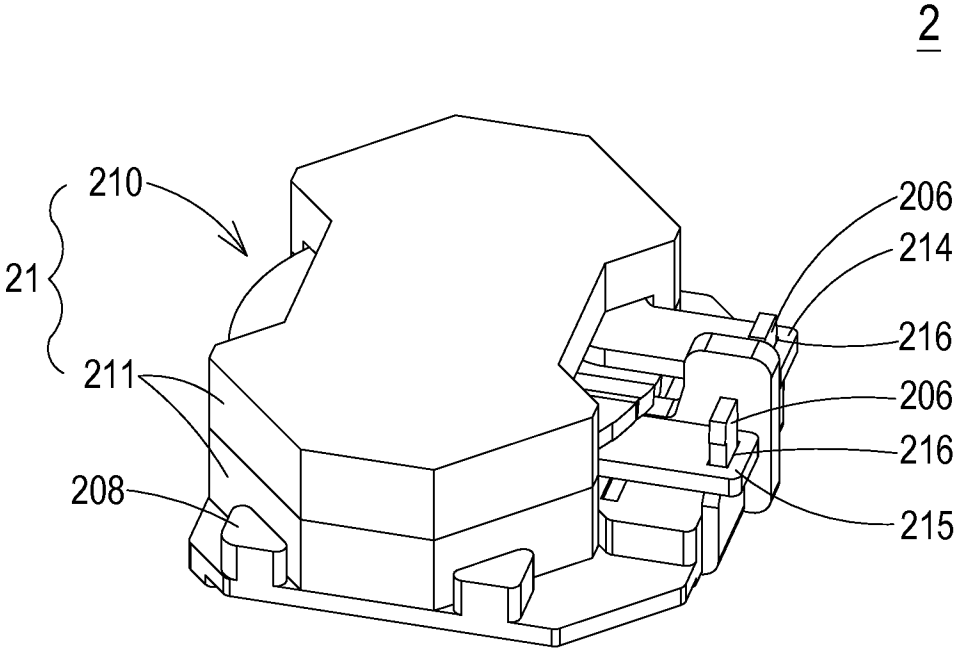
FIG. 4A is a schematic assembled view illustrating the magnetic module of FIG. 2.
Figure 4B:
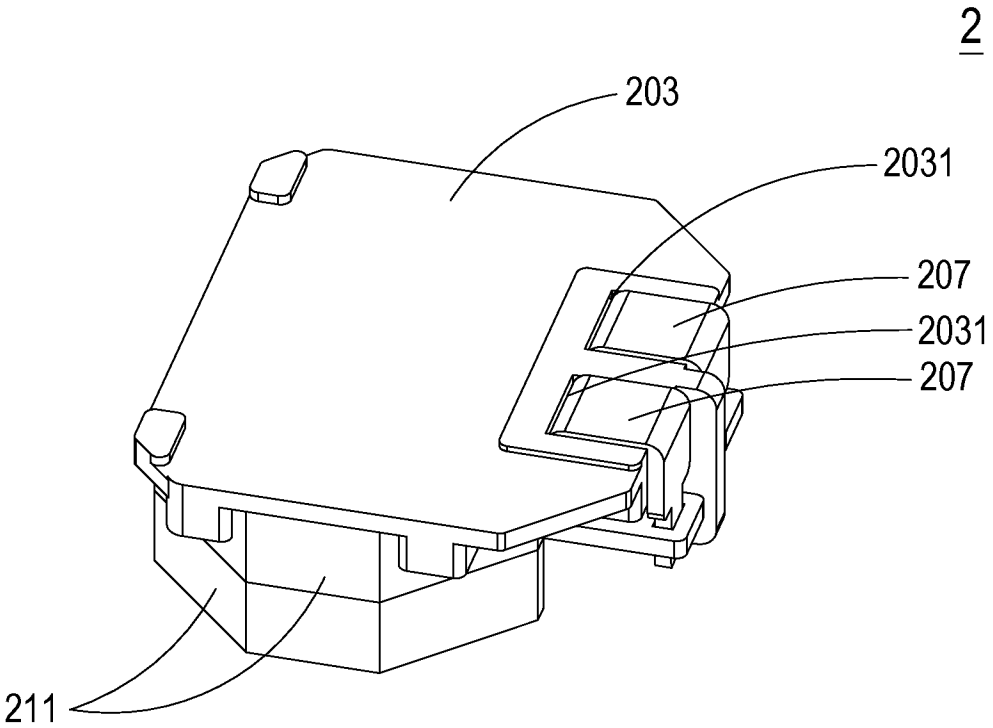
FIG. 4B is a schematic rear view illustrating the magnetic module of FIG. 4A.

FIG. 4A is a schematic assembled view illustrating the magnetic module of FIG. 2. FIG. 4B is a schematic rear view illustrating the magnetic module of FIG. 4A. Hereinafter, a process of assembling the magnetic module will be illustrated with reference to FIGS. 2, 4A and 4B. Firstly, the middle posts 2114 of the first magnetic core part 2111 and the second magnetic core part 2112 are both embedded into the hollow portion 213 of the conductive assembly 210. Then, the lateral posts 2113 of the first magnetic core part 2111 are contacted with corresponding lateral posts 2113 of the second magnetic core part 2112, so that the conductive assembly 210 is fixed between the first magnetic core part 2111 and the second magnetic core part 2112. Meanwhile, the inductor 21 is assembled. After the inductor 21 is assembled, the fixing parts 216 of the first terminal 214 and the second terminal 215 of the conductive assembly 210 are engaged with corresponding protrusion parts 206 of the first conductive structure 204 and the second conductive structure 205 of the base 20. That is, the protrusion parts 206 of the first conductive structure 204 and the second conductive structure 205 are penetrated through corresponding fixing parts 216 (i.e. the slots) of the first terminal 214 and the second terminal 215, so that the first terminal 214 and the second terminal 215 are supported by each stepped part T of the first conductive structure 204 and the second conductive structure 205. Meanwhile, the first terminal 214 and the second terminal 215 of the conductive assembly 210 are electrically connected with the first conductive structure 204 and the second conductive structure 205, respectively. Then, the magnetic core assembly 211 of the inductor 21 is confined by the position-limiting structures 208, so that the inductor 21 is securely fixed on the first surface 202 of the base 20. Meanwhile, the magnetic module 2 is produced. Under this circumstance, the bottom parts 207 of the first conductive structure 204 and the second conductive structure 205 on the second surface 203 of the base 20 are welded on a circuit board (not shown).

Figure 5:
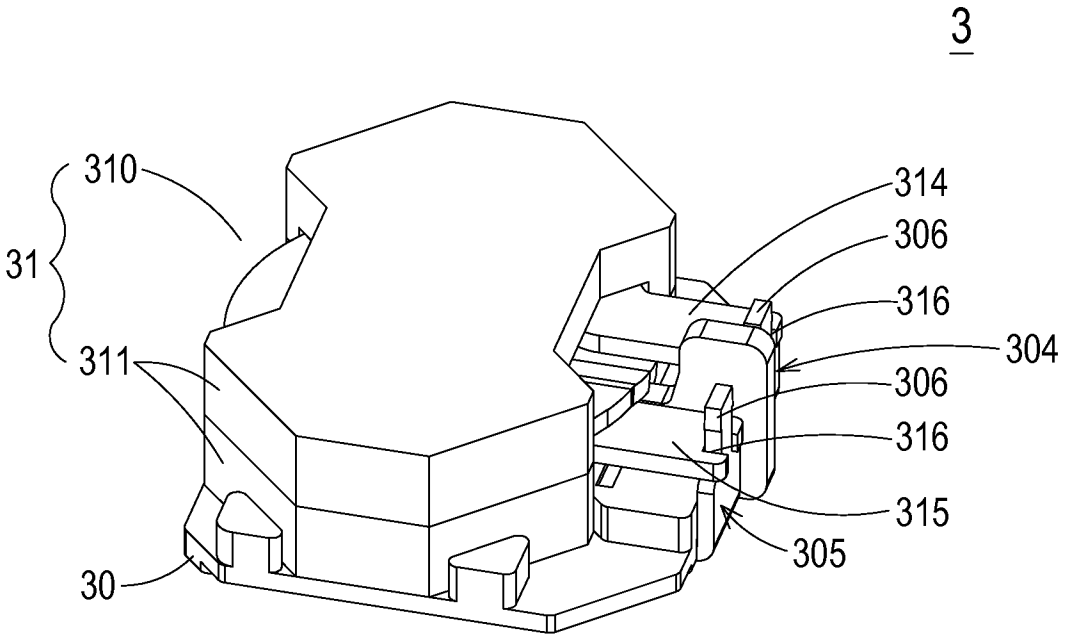
FIG. 5 is a schematic assembled view illustrating a magnetic module according to a second embodiment of the present disclosure.

In some embodiments, the fixing parts of the conductive assembly are not limited to the rectangular slots. FIG. 5 is a schematic assembled view illustrating a magnetic module according to a second embodiment of the present disclosure. Except that the fixing part 316 of the first terminal 314 and the second terminal 315 of the conductive assembly 310 are U-shaped notches, the configurations of other components of the magnetic core assembly 311 and the base 30 of the magnetic module 3 are similar to those of the first embodiment, and are not redundantly described herein. In this embodiment, the protrusion parts 306 of the first conductive structure 304 and the second conductive structure 305 are received within the fixing parts 316 (i.e. the notches) of the first terminal 314 and the second terminal 315 of the conductive assembly 310. Consequently, the protrusion parts 306 of the first conductive structure 304 and the second conductive structure 305 are engaged with the fixing parts 316 of the first terminal 314 and the second terminal 315 of the conductive assembly 310. Meanwhile, the first terminal 314 and the second terminal 315 of the inductor 31 are electrically connected with the first conductive structure 304 and the second conductive structure 305 of the base 30, respectively.

From the above description, the present disclosure provides a magnetic module. The magnetic module comprises a magnetic element and a base. The fixing parts of the first terminal and the second terminal of the magnetic element are engaged with the protrusion parts of the first conductive structure and the second conductive structure of the base. In addition, the conductive structures of the base are directly connected with the circuit board. Consequently, the terminals of the magnetic elements are directly electrically connected with corresponding conductive structures of the base, and the terminals of the magnetic elements are securely fixed by corresponding conductive structures of the base without being shifted. Moreover, since the bottom parts of the conductive structures of the base are connected with the circuit board, the possibility of deforming the terminals of the conductive assembly during transferring the magnetic module through the reflow furnace will be minimized. Under this circumstance, the evenness of the magnetic module is increased, and performance thereof is enhanced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A base for holding a magnetic element, said magnetic element comprising a conductive assembly and a magnetic core assembly, said conductive assembly having a first terminal and a second terminal, each of which has a fixing part, said base comprising:

a base body having a first surface, wherein said magnetic element is disposed on said first surface;

first conductive structure and a second conductive structure, each of which comprising a protrusion part and a stepped part, wherein each protrusion part of said first conductive structure and said second conductive structure is extended from corresponding stepped part, said first conductive structure and said second conductive structure are fixed on said base body, and each protrusion part of said first conductive structure and said second conductive structure is penetrated through corresponding fixing part of said first terminal and said second terminal, respectively, so that said first terminal and said second terminal are fixed by and electrically connected with said first conductive structure and said second conductive, respectively, wherein each conductive structure further has a bottom part, and said base body further has a second surface opposed to said first surface, and wherein said bottom part is disposed on said second surface, and said magnetic element is electrically connected with a circuit board through said bottom part;

a plurality of concave structures, which are formed in said second surface of said base body for accommodating corresponding bottom parts of said conductive structures;

a partition plate vertically disposed on said first surface of said base body and arranged between said first conductive structure and said second conductive structure, wherein said partition plate has a top surface at a horizontal level higher than top surfaces of said protrusion structures of said first conductive structure and said second conductive structure; and a plurality of position-limiting structures, which are disposed on said first surface of said base body, wherein said position-limiting structures have a profile matching a shape of said magnetic core assembly, so that said magnetic core assembly is positioned and surrounded by said position-limiting structures.

2. The base according to claim 1, wherein said plurality of conductive structures are vertically disposed on said first surface of said base body, each conductive structure has a protrusion part, and each terminal has a fixing part, and wherein said protrusion part is engaged with a corresponding said fixing part.

3. The base according to claim 2, wherein said protrusion part has a profile matching a shape of said fixing part of a corresponding said terminal.

4. A magnetic module, comprising:

a magnetic element comprising:

a conductive assembly comprising a first terminal and a second terminal, each of which has a fixing part; and a magnetic core assembly partially embedded within said conductive assembly; and a base comprising:

a base body having a first surface, wherein said magnetic element is disposed on said first surface;

a first conductive structure and a second conductive structure, each of which comprising a protrusion part and a stepped part, wherein each protrusion part of said first conductive structure and said second conductive structure is extended from corresponding stepped part, said first conductive structure and said second conductive structure are fixed on said base body and each protrusion part of said first conductive structure and said second conductive structure is penetrated through corresponding fixing part of said first terminal and said second terminal, respectively, so that said first terminal and said second terminal are fixed by and electrically connected with said first conductive structure and said second conductive, respectively, wherein each conductive structure further has a bottom part, and said base body further has a second surface opposed to said first surface, and wherein said bottom part is disposed on said second surface, and said magnetic element is electrically connected with a circuit board through said bottom part;

a plurality of concave structures, which are formed in said second surface of said base body for accommodating corresponding bottom parts of said conductive structures; and a partition plate vertically disposed on said first surface of said base body and arranged between said first conductive structure and said second conductive structure, wherein said partition plate has a top surface at a horizontal level higher than top surfaces of said protrusion structures of said first conductive structure and said second conductive structure; and a plurality of position-limiting structures, which are disposed on said first surface of said base body, wherein said position-limiting structures have a profile matching a shape of said magnetic core assembly, so that said magnetic core assembly is positioned and surrounded by said position-limiting structures.

5. The magnetic module according to claim 4, wherein said magnetic module is a surface mount device (SMD).

6. The magnetic module according to claim 4, wherein said fixing part is a slot, and a protrusion part of a corresponding said conductive structure is penetrated through said slot.

7. The magnetic module according to claim 4, wherein said fixing part is a notch, and a protrusion part of a corresponding said conductive structure is received within said notch.

* * * * *